US009324280B2

(12) United States Patent
Denda et al.

(10) Patent No.: US 9,324,280 B2
(45) Date of Patent: Apr. 26, 2016

(54) LIGHT SOURCE APPARATUS AND METHOD OF CONTROLLING SAME

(71) Applicant: CANON KABUSHIKI KAISHA, Tokyo (JP)

(72) Inventors: Hayato Denda, Machida (JP); Makoto Onogi, Fujisawa (JP); Masanao Kurita, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/463,304

(22) Filed: Aug. 19, 2014

(65) Prior Publication Data

US 2015/0054411 A1 Feb. 26, 2015

(30) Foreign Application Priority Data

Aug. 26, 2013 (JP) ..... 2013-174600

(51) Int. Cl.
*G09G 3/34* (2006.01)
*H05B 37/02* (2006.01)

(52) U.S. Cl.
CPC ..... *G09G 3/3426* (2013.01)

(58) Field of Classification Search
USPC ..... 315/151, 152, 192, 291, 294, 307, 308, 315/312; 345/102, 103, 204, 690
See application file for complete search history.

(56) References Cited

U.S. PATENT DOCUMENTS

2012/0139885 A1* 6/2012 Iwasa ..... G09G 3/3426 345/207
2013/0321491 A1* 12/2013 Heishi ..... G09G 3/3426 345/690

FOREIGN PATENT DOCUMENTS

JP 2001-142409 A 5/2001
JP 2011-027941 A 2/2011

* cited by examiner

*Primary Examiner* — Douglas W Owens
*Assistant Examiner* — Thai Pham
(74) *Attorney, Agent, or Firm* — Cowan, Liebowitz & Latman, P.C.

(57) ABSTRACT

A light source apparatus includes: a light-emitting unit which includes a plurality of emission areas emitting light periodically at different phases and in which at least two light sources are disposed in each emission area; a detection unit configured to detect light from the light-emitting unit; and a control unit configured to select the plurality of light sources sequentially and to perform lighting-control of temporarily reducing emission brightness of light sources other than the selected light source, wherein the control unit selects lighting-control target light sources so that lighting-control is sequentially performed on light sources disposed in different emission areas among the plurality of emission areas.

19 Claims, 13 Drawing Sheets

FIG. 1A
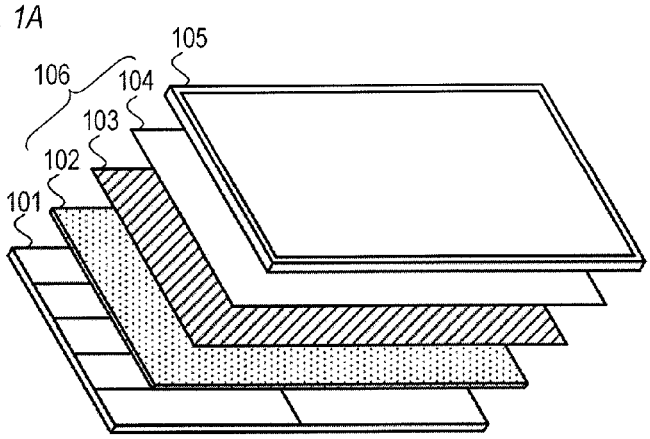
FIG. 1B
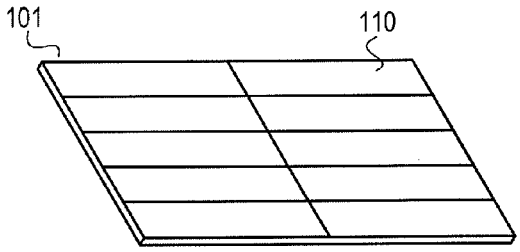
FIG. 1C
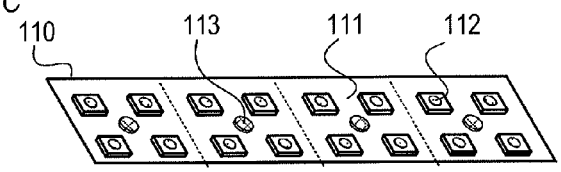
FIG. 1D
101
| | | | | | | | | | |
|---|---|---|---|---|---|---|---|---|---|
| 110(1,1) | 111 (1,1,1) | 111 (1,1,2) | 111 (1,1,3) | 111 (1,1,4) | 111 (1,2,1) | 111 (1,2,2) | 111 (1,2,3) | 111 (1,2,4) | 110(1,2) |
| 110(2,1) | 111 (2,1,1) | 111 (2,1,2) | 111 (2,1,3) | 111 (2,1,4) | 111 (2,2,1) | 111 (2,2,2) | 111 (2,2,3) | 111 (2,2,4) | 110(2,2) |
| 110(3,1) | 111 (3,1,1) | 111 (3,1,2) | 111 (3,1,3) | 111 (3,1,4) | 111 (3,2,1) | 111 (3,2,2) | 111 (3,2,3) | 111 (3,2,4) | 110(3,2) |
| 110(4,1) | 111 (4,1,1) | 111 (4,1,2) | 111 (4,1,3) | 111 (4,1,4) | 111 (4,2,1) | 111 (4,2,2) | 111 (4,2,3) | 111 (4,2,4) | 110(4,2) |
| 110(5,1) | 111 (5,1,1) | 111 (5,1,2) | 111 (5,1,3) | 111 (5,1,4) | 111 (5,2,1) | 111 (5,2,2) | 111 (5,2,3) | 111 (5,2,4) | 110(5,2) |

FIG. 5A

| SELECTION ORDER | LIGHT SOURCE | SELECTION ORDER | LIGHT SOURCE |
|---|---|---|---|
| 1 | 111(1,1,1) | 21 | 111(3,2,1) |
| 2 | 111(1,1,2) | 22 | 111(3,2,2) |
| 3 | 111(1,1,3) | 23 | 111(3,2,3) |
| 4 | 111(1,1,4) | 24 | 111(3,2,4) |
| 5 | 111(1,2,1) | 25 | 111(4,1,1) |
| 6 | 111(1,2,2) | 26 | 111(4,1,2) |
| 7 | 111(1,2,3) | 27 | 111(4,1,3) |
| 8 | 111(1,2,4) | 28 | 111(4,1,4) |
| 9 | 111(2,1,1) | 29 | 111(4,2,1) |
| 10 | 111(2,1,2) | 30 | 111(4,2,2) |
| 11 | 111(2,1,3) | 31 | 111(4,2,3) |
| 12 | 111(2,1,4) | 32 | 111(4,2,4) |
| 13 | 111(2,2,1) | 33 | 111(5,1,1) |
| 14 | 111(2,2,2) | 34 | 111(5,1,2) |
| 15 | 111(2,2,3) | 35 | 111(5,1,3) |
| 16 | 111(2,2,4) | 36 | 111(5,1,4) |
| 17 | 111(3,1,1) | 37 | 111(5,2,1) |
| 18 | 111(3,1,2) | 38 | 111(5,2,2) |
| 19 | 111(3,1,3) | 39 | 111(5,2,3) |
| 20 | 111(3,1,4) | 40 | 111(5,2,4) |

FIG. 5B

| | | | | | | | | |
|---|---|---|---|---|---|---|---|---|
| AREA 1 | 1 | 2 | 3 | 4 | 5 | 6 | 7 | 8 |
| AREA 2 | 9 | 10 | 11 | 12 | 13 | 14 | 15 | 16 |
| AREA 3 | 17 | 18 | 19 | 20 | 21 | 22 | 23 | 24 |
| AREA 4 | 25 | 26 | 27 | 28 | 29 | 30 | 31 | 32 |
| AREA 5 | 33 | 34 | 35 | 36 | 37 | 38 | 39 | 40 |

FIG. 7

| | BRIGHTNESS DECREASE AMOUNT OF AREA 1 | BRIGHTNESS DECREASE AMOUNT OF AREA 2 | BRIGHTNESS DECREASE AMOUNT OF AREA 3 | BRIGHTNESS DECREASE AMOUNT OF AREA 4 | BRIGHTNESS DECREASE AMOUNT OF AREA 5 |
|---|---|---|---|---|---|
| DURING INDIVIDUAL LIGHT SOURCE LIGHTING-CONTROL FOR LIGHT SOURCE OF AREA 1 | 65 | 35 | 35 | 75 | 85 |
| DURING INDIVIDUAL LIGHT SOURCE LIGHTING-CONTROL FOR LIGHT SOURCE OF AREA 2 | 90 | 75 | 35 | 35 | 65 |
| DURING INDIVIDUAL LIGHT SOURCE LIGHTING-CONTROL FOR LIGHT SOURCE OF AREA 3 | 100 | 100 | 80 | 35 | 15 |
| DURING INDIVIDUAL LIGHT SOURCE LIGHTING-CONTROL FOR LIGHT SOURCE OF AREA 4 | 40 | 85 | 100 | 85 | 45 |
| DURING INDIVIDUAL LIGHT SOURCE LIGHTING-CONTROL FOR LIGHT SOURCE OF AREA 5 | 15 | 35 | 80 | 100 | 100 |

FIG. 9A

| SELECTION ORDER | LIGHT SOURCE | SELECTION ORDER | LIGHT SOURCE |
|---|---|---|---|
| 1 | 111(1,1,1) | 21 | 111(1,2,1) |
| 2 | 111(2,1,1) | 22 | 111(2,2,1) |
| 3 | 111(3,1,1) | 23 | 111(3,2,1) |
| 4 | 111(4,1,1) | 24 | 111(4,2,1) |
| 5 | 111(5,1,1) | 25 | 111(5,2,1) |
| 6 | 111(1,1,2) | 26 | 111(1,2,2) |
| 7 | 111(2,1,2) | 27 | 111(2,2,2) |
| 8 | 111(3,1,2) | 28 | 111(3,2,2) |
| 9 | 111(4,1,2) | 29 | 111(4,2,2) |
| 10 | 111(5,1,2) | 30 | 111(5,2,2) |
| 11 | 111(1,1,3) | 31 | 111(1,2,3) |
| 12 | 111(2,1,3) | 32 | 111(2,2,3) |
| 13 | 111(3,1,3) | 33 | 111(3,2,3) |
| 14 | 111(4,1,3) | 34 | 111(4,2,3) |
| 15 | 111(5,1,3) | 35 | 111(5,2,3) |
| 16 | 111(1,1,4) | 36 | 111(1,2,4) |
| 17 | 111(2,1,4) | 37 | 111(2,2,4) |
| 18 | 111(3,1,4) | 38 | 111(3,2,4) |
| 19 | 111(4,1,4) | 39 | 111(4,2,4) |
| 20 | 111(5,1,4) | 40 | 111(5,2,4) |

FIG. 9B

| | | | | | | | | |
|---|---|---|---|---|---|---|---|---|
| AREA 1 | 1 | 6 | 11 | 16 | 21 | 26 | 31 | 36 |
| AREA 2 | 2 | 7 | 12 | 17 | 22 | 27 | 32 | 37 |
| AREA 3 | 3 | 8 | 13 | 18 | 23 | 28 | 33 | 38 |
| AREA 4 | 4 | 9 | 14 | 19 | 24 | 29 | 34 | 39 |
| AREA 5 | 5 | 10 | 15 | 20 | 25 | 30 | 45 | 40 |

FIG. 11A

| SELECTION ORDER | LIGHT SOURCE | PRIORITY ORDER | SELECTION ORDER | LIGHT SOURCE | PRIORITY ORDER |
|---|---|---|---|---|---|
| 1 | 111(1,1,4) | 1 | 21 | 111(1,1,2) | 3 |
| 2 | 111(2,1,4) | 1 | 22 | 111(2,1,2) | 3 |
| 3 | 111(3,1,4) | 1 | 23 | 111(3,1,2) | 3 |
| 4 | 111(4,1,4) | 1 | 24 | 111(4,1,2) | 3 |
| 5 | 111(5,1,4) | 1 | 25 | 111(5,1,2) | 3 |
| 6 | 111(1,2,1) | 1 | 26 | 111(1,2,3) | 3 |
| 7 | 111(2,2,1) | 1 | 27 | 111(2,2,3) | 3 |
| 8 | 111(3,2,1) | 1 | 28 | 111(3,2,3) | 3 |
| 9 | 111(4,2,1) | 1 | 29 | 111(4,2,3) | 3 |
| 10 | 111(5,2,1) | 1 | 30 | 111(5,2,3) | 3 |
| 11 | 111(1,1,3) | 2 | 31 | 111(1,1,1) | 4 |
| 12 | 111(2,1,3) | 2 | 32 | 111(2,1,1) | 4 |
| 13 | 111(3,1,3) | 2 | 33 | 111(3,1,1) | 4 |
| 14 | 111(4,1,3) | 2 | 34 | 111(4,1,1) | 4 |
| 15 | 111(5,1,3) | 2 | 35 | 111(5,1,1) | 4 |
| 16 | 111(1,2,2) | 2 | 36 | 111(1,2,4) | 4 |
| 17 | 111(2,2,2) | 2 | 37 | 111(2,2,4) | 4 |
| 18 | 111(3,2,2) | 2 | 38 | 111(3,2,4) | 4 |
| 19 | 111(4,2,2) | 2 | 39 | 111(4,2,4) | 4 |
| 20 | 111(5,2,2) | 2 | 40 | 111(5,2,4) | 4 |

FIG. 11B

| | | | | | | | | |
|---|---|---|---|---|---|---|---|---|
| AREA 1 | 31 | 21 | 11 | 1 | 6 | 16 | 26 | 36 |
| AREA 2 | 32 | 22 | 12 | 2 | 7 | 17 | 27 | 37 |
| AREA 3 | 33 | 23 | 13 | 3 | 8 | 18 | 28 | 38 |
| AREA 4 | 34 | 24 | 14 | 4 | 9 | 19 | 29 | 39 |
| AREA 5 | 35 | 25 | 15 | 5 | 10 | 20 | 30 | 40 |

FIG. 12A

| SELECTION ORDER | LIGHT SOURCE | SELECTION ORDER | LIGHT SOURCE |
|---|---|---|---|
| 1 | 111(1,1,1) | 21 | 111(1,2,1) |
| 2 | 111(4,1,1) | 22 | 111(4,2,1) |
| 3 | 111(2,1,1) | 23 | 111(2,2,1) |
| 4 | 111(3,1,1) | 24 | 111(3,2,1) |
| 5 | 111(5,1,1) | 25 | 111(5,2,1) |
| 6 | 111(1,1,2) | 26 | 111(1,2,2) |
| 7 | 111(4,1,2) | 27 | 111(4,2,2) |
| 8 | 111(2,1,2) | 28 | 111(2,2,2) |
| 9 | 111(3,1,2) | 29 | 111(3,2,2) |
| 10 | 111(5,1,2) | 30 | 111(5,2,2) |
| 11 | 111(1,1,3) | 31 | 111(1,2,3) |
| 12 | 111(4,1,3) | 32 | 111(4,2,3) |
| 13 | 111(2,1,3) | 33 | 111(2,2,3) |
| 14 | 111(3,1,3) | 34 | 111(3,2,3) |
| 15 | 111(5,1,3) | 35 | 111(5,2,3) |
| 16 | 111(1,1,4) | 36 | 111(1,2,4) |
| 17 | 111(4,1,4) | 37 | 111(4,2,4) |
| 18 | 111(2,1,4) | 38 | 111(2,2,4) |
| 19 | 111(3,1,4) | 39 | 111(3,2,4) |
| 20 | 111(5,1,4) | 40 | 111(5,2,4) |

FIG. 12B

| | | | | | | | | |
|---|---|---|---|---|---|---|---|---|
| AREA 1 | 1 | 6 | 11 | 16 | 21 | 26 | 31 | 36 |
| AREA 2 | 3 | 8 | 13 | 18 | 23 | 28 | 33 | 38 |
| AREA 3 | 4 | 9 | 14 | 19 | 24 | 29 | 34 | 39 |
| AREA 4 | 2 | 7 | 12 | 17 | 22 | 27 | 32 | 37 |
| AREA 5 | 5 | 10 | 15 | 20 | 25 | 30 | 35 | 40 |

LIGHT SOURCE APPARATUS AND METHOD OF CONTROLLING SAME

BACKGROUND OF THE INVENTION

1. Field of the Invention

The present invention relates to a light source apparatus and a method of controlling the same.

2. Description of the Related Art

A color image display apparatus is available that includes a color liquid crystal panel having a color filter and a light source apparatus (backlight apparatus) that emits white light to aback surface of the color liquid crystal panel is known.

Conventionally, a fluorescent lamp such as a cold cathode fluorescent lamp (CCFL) is mainly used as a light-emitting element of the light source apparatus. However, in recent years, a light emitting diode (LED), which is excellent in power consumption reduction, service life, color reproducibility, and environmental load reduction, is used as the light-emitting element of the light source apparatus.

A light source apparatus (LED backlight apparatus) which uses LEDs as the light-emitting element includes a number of LEDs. Japanese Patent Application Publication No. 2001-142409 discloses a LED backlight apparatus which has a plurality of light sources each including at least one LED. Moreover, Japanese Patent Application Publication No. 2001-142409 discloses that emission brightness of a light source is controlled in respective light sources. The emission brightness of a light source that emits light to a region of the screen of a color image display apparatus in which a dark image is displayed is decreased, whereby the power consumption decreases and the contrast of the image is improved. Such brightness control in respective light sources according to image characteristics is referred to as local dimming control.

In a light source apparatus, there is a problem that the emission brightness of a light source changes. The emission brightness changes, for example, due to a change in emission characteristics of a light-emitting element resulting from a change in temperature, aging of the light-emitting element, and the like. In a light-emitting apparatus having a plurality of light sources, as a result of variation in the temperature and the degree of aging among the light sources, the emission brightness of the plurality of light sources are varied (becomes uneven).

As a method of suppressing a change in the emission brightness and a brightness unevenness, a method of adjusting the emission brightness of the light source using an optical sensor is known. Specifically, a method of providing an optical sensor that detects reflection light which has been reflected from an optical sheet (optical member) provided in a light source apparatus among light beams emitted from the light source apparatus and has returned toward the light source and adjusting emission brightness of the light source based on a detection value (optical detection value) of the optical sensor is known. In a light-emitting apparatus having a plurality of light sources, individual light source lighting-control is performed such that a plurality of light sources is sequentially selected and only the selected light source is lit. When each light source is subjected to such individual light source lighting-control, light (specifically, reflection light) from the light source is detected by the optical sensor. After that, the emission brightnesses of respective light sources are adjusted based on the optical detection value of each light source. Such a technique is disclosed in Japanese Patent Application Publication No. 2011-27941.

SUMMARY OF THE INVENTION

From the perspective of convenience of a light source apparatus (an image display apparatus which uses the light source apparatus), it is preferable that the emission brightness of respective light sources is adjusted during normal usage thereof. Due to this, in a light-emitting apparatus having a plurality of light sources, it is preferable to perform such individual light source lighting-control that lit states of respective light sources are switched so that only one light source is lit when the respective light sources perform a normal light emitting operation. However, when such individual light source lighting-control is performed, the brightness on a light-emitting surface of a light source apparatus or the brightness on the screen of an image display apparatus which uses the light source apparatus may change greatly due to the individual light source lighting-control. Moreover, when such individual light source lighting-control is sequentially performed on a plurality of light sources, a large brightness variation may occur repeatedly. Further, the large brightness variation that occurs repeatedly may be perceived by users as a sense of disturbance (specifically, flicker).

The present invention provides a technique capable of suppressing a flicker effect perceived by users by sequentially performing individual light source lighting-control on a plurality of light sources.

The present invention in its first aspect provides a light source apparatus comprising:

a light-emitting unit which includes a plurality of emission areas emitting light periodically at different phases and in which at least two light sources are disposed in each emission area;

a detection unit configured to detect light from the light-emitting unit; and a control unit configured to select the plurality of light sources of the light-emitting unit sequentially during the periodic light emission of the plurality of emission areas and to perform lighting-control of temporarily reducing emission brightness of light sources other than the selected light source so that light from the selected light source is detected by the detection unit, wherein the control unit selects lighting-control target light sources so that lighting-control is sequentially performed on light sources disposed in different emission areas among the plurality of emission areas.

The present invention in its second aspect provides a light source apparatus comprising:

a light-emitting unit which includes a plurality of emission areas emitting light periodically at different phases and in which at least two light sources are disposed in each emission area;

a detection unit which detects light from the light-emitting unit; and a control unit which selects the plurality of light sources of the light-emitting unit sequentially during the periodic light emission of the plurality of emission areas and performs lighting-control of temporarily reducing emission brightness of light sources other than the selected light source so that light from the selected light source is detected by the detection unit, wherein the control unit selects lighting-control target light sources in such an order that a frequency of a low-frequency component of a brightness variation in each of the plurality of emission areas is 60 Hz or higher.

The present invention in its third aspect provides a method of controlling a light source apparatus including:

a light-emitting unit which includes a plurality of emission areas that emits light periodically at different phases and in which at least two light sources are disposed in each emission area; and a detection unit which detects light from the light-emitting unit, the method comprising:

a selecting step of selecting a plurality of light sources of the light-emitting unit sequentially; and a controlling step of performing lighting-control of temporarily reducing emission brightness of light sources other than the selected light source so that light from the selected light source is detected by the detection unit during the periodic light emission of the plurality of emission areas, wherein in the selecting step, the lighting-control target light sources are selected so that the lighting-control is sequentially performed on light sources disposed in different emission areas among the plurality of emission areas.

The present invention in its fourth aspect provides a method of controlling a light source apparatus including:

a light-emitting unit which includes a plurality of emission areas emitting light periodically at different phases and in which at least two light sources are disposed in each emission area; and a detection unit which detects light from the light-emitting unit, the method comprising:

a selecting step of selecting a plurality of light sources of the light-emitting unit sequentially; and a controlling step of performing lighting-control of temporarily reducing emission brightness of light sources other than the selected light source so that light from the selected light source is detected by the detection unit during the periodic light emission of the plurality of emission areas, wherein in the selecting step, the lighting-control target light sources are selected in such an order that a frequency of a low-frequency component of a brightness variation in each of the plurality of emission areas is 60 Hz or higher.

The present invention in its fifth aspect provides a non-transitory computer readable medium that stores a program, wherein the program causes a computer to execute the method.

According to the present invention, it is possible to suppress a flicker effect perceived by users by sequentially performing individual light source lighting-control on a plurality of light sources.

Further features of the present invention will become apparent from the following description of exemplary embodiments with reference to the attached drawings.

BRIEF DESCRIPTION OF THE DRAWINGS

FIGS. 1A to 1D are diagrams illustrating an example of a configuration of an image display apparatus according to the present embodiment;

FIGS. 5A and 5B are diagrams illustrating an example of the orders of selecting light sources in which a flicker effect is perceived;

FIG. 7 is a table illustrating an example of a brightness decrease amount caused by individual light source lighting-control;

FIGS. 9A and 9B are diagrams illustrating an example of a light source selecting order according to the present embodiment;

FIGS. 11A and 11B are diagrams illustrating an example of a light source selecting order according to the present embodiment;

FIGS. 12A and 12B are diagrams illustrating an example of a light source selecting order according to the present embodiment.

DESCRIPTION OF THE EMBODIMENTS

Figure 2:
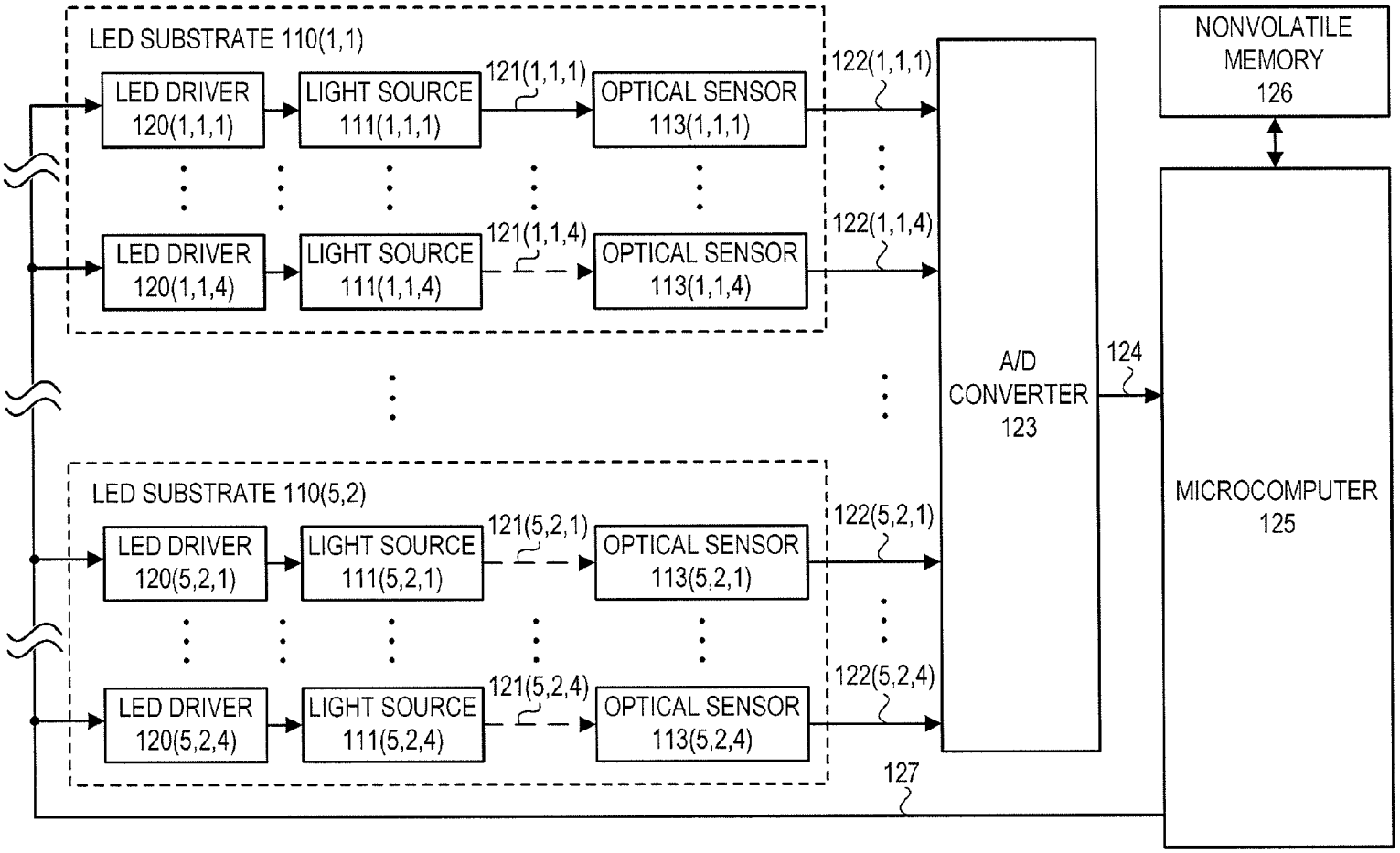
FIG. 2 is a block diagram illustrating an example of a configuration of a backlight apparatus according to the present embodiment.

Hereinafter, a light source apparatus and a method of controlling the same according to an embodiment of the present invention will be described.

In the following description, an example in which a light source apparatus according to the present embodiment is used in an image display apparatus that displays an image on a screen by modulating light emitted from a light source apparatus is described. However, the light source apparatus according to the present embodiment is not limited to this. The light source apparatus according to the present embodiment may be a lighting apparatus such as, for example, a street lamp or an indoor lighting.

In the following description, an example in which the image display apparatus according to the present embodiment is a transmissive liquid crystal display apparatus is described. However, the image display apparatus according to the present embodiment is not limited to this. The image display apparatus according to the present embodiment may be an image display apparatus that displays an image on a screen by modulating light emitted from a light source apparatus. For example, the image display apparatus according to the present embodiment may be a reflective liquid crystal display apparatus. Moreover, the image display apparatus according to the present embodiment may be a micro electro mechanical system (MEMS) shutter display which uses a MEMS shutter instead of a liquid crystal element.

Further, in the following description, an example in which the image display apparatus according to the present embodiment is a color image display apparatus is described. However, the image display apparatus according to the present embodiment may be a monochrome image display apparatus.

FIG. 1A is a schematic diagram illustrating an example of a configuration of a color image display apparatus according to the present embodiment. The color image display apparatus includes a backlight apparatus (light source apparatus) and a color liquid crystal panel 105. The backlight apparatus includes a light source substrate 101, a diffuser 102, a light condensing sheet 103, a reflective polarizing film 104, and the like.

The light source substrate 101 is a light-emitting unit that emits light (white light) to a back surface of the liquid crystal panel 105. The light source substrate 101 includes a plurality of light sources. The light source includes at least one light-emitting element. A light-emitting diode (LED), a cold cathode fluorescent lamp, an organic EL element, and the like can be used as the light-emitting element.

The diffuser 102, the light condensing sheet 103, and the reflective polarizing film 104 are disposed in parallel to the light source substrate 101 and cause an optical change in the light from the light source substrate 101.

Specifically, the diffuser 102 diffuses light from the plurality of light-emitting elements (in the present embodiment, LED chips) so that the light source substrate 101 functions as a surface light source.

The light condensing sheet 103 condenses the white light beams which have been diffused by the diffuser 102 and have entered at various incidence angles in a front direction (toward the color liquid crystal panel 105) to thereby improve a front brightness (the brightness in the front direction).

The reflective polarizing film 104 efficiently polarizes the entering white light beams to thereby improve the front brightness.

The diffuser 102, the light condensing sheet 103, and the reflective polarizing film 104 are used in an overlapped state. Hereinafter, these optical members will be collectively referred to as an optical sheet 106. The optical sheet 106 may include a member other than the optical members and may not include at least one of the optical members. Moreover, the optical sheet 106 and the color liquid crystal panel 105 may be integrated with each other.

The color liquid crystal panel 105 includes a plurality of pixels each including R, G, and B sub-pixels that transmit light of the colors red, green, and blue, respectively, and displays a color image by controlling the brightness of the emitted white light in respective sub-pixels.

A backlight apparatus having the above-described configuration (the configuration illustrated in FIG. 1A) is generally referred to as a direct-type backlight apparatus.

FIG. 1B is a schematic diagram illustrating an example of a configuration of the light source substrate 101.

The light source substrate 101 includes a plurality of light sources.

In the example of FIG. 1B, the light source substrate 101 includes ten LED substrates 110 in total arranged in a matrix form of 5 rows by 2 columns. In the present embodiment, the light source substrate 101 includes a plurality of LED substrates. However, the light source substrate 101 may include only one LED substrate. For example, ten LED substrates illustrated in FIG. 1B may be replaced with one LED substrate.

FIG. 1C is a schematic diagram illustrating an example of a configuration of the LED substrate 110.

Each LED substrate 110 includes four light sources 111 in total arranged in 1 row by 4 columns. That is, the light source substrate 101 includes forty light sources 111 in total arranged in 5 rows by 8 columns.

Four light-emitting elements (LED chips 112) are provided in each light source 111, and the emission brightnesses of the respective light sources 111 can be controlled individually. A white LED that emits white light, for example, can be used as the LED chip 112. A chip configured to obtain white light using a plurality of LEDs (for example, red, green, and blue LEDs that emit light of the colors red, green, and blue, respectively) of which the colors of light emitted are different may be used as the LED chip 112. The number of LED chips 112 provided in one light source 111 may be larger or smaller than 4. Only one LED chip 112 may be provided in one light source.

An optical sensor 113 (detecting unit) that detects light emitted from the light source substrate 101 and outputs a detection value (optical detection value) is provided in the LED substrate 110. A portion of the light from the light source 111 is reflected from an optical sheet (a diffuser or a reflective polarizing film) or the like and is returned toward the light source 111. The optical sensor 113 is provided so as to face the optical sheet 106 and detects the reflection light returned toward the light source 111. The emission brightness of the light source 111 can be predicted from the brightness of the reflection light. In the present embodiment, one optical sensor 113 is provided in each light source 111. Thus, in the example of FIG. 1C, four optical sensors 113 are provided in one LED substrate 110. A sensor such as a photodiode or a phototransistor that outputs brightness as an optical detection value can be used as the optical sensor 113. Moreover, a color sensor that outputs a change in color or the like other than brightness maybe used as the optical sensor 113.

The optical sensor 113 may be provided so that light emitted from the light source substrate 101 enters directly the optical sensor 113. For example, the optical sensor 113 may be provided so as to face an emission surface of the light source substrate 101.

A plurality of optical sensors 113 may be provided in one light source 111, and one optical sensor 113 may be provided in a plurality of light sources 111.

FIG. 1D is a schematic diagram illustrating an example of the layout of the LED substrates 110 and the light sources 111 when seen from the front side (the color liquid crystal panel 105). A LED substrate 110 (1,2) is adjacent to the right side of a LED substrate 110 (1,1) disposed at the top-left end. A LED substrate 110 (2,1), a LED substrate 110 (3,1), a LED substrate 110 (4,1), and a LED substrate 110 (5,1) are arranged in that order on the lower side of the LED substrate 110 (1,1). A LED substrate 110 (2,2) is adjacent to the right side of the LED substrate 110 (2,1). A LED substrate 110 (3,2) is adjacent to the right side of the LED substrate 110 (3,1). A LED substrate 110 (4,2) is adjacent to the right side of the LED substrate 110 (4,1). A LED substrate 110 (5,2) is adjacent to the right side of the LED substrate 110 (5,1).

A LED substrate 110 (X,Y) (X=1 to 5, Y=1 to 2) includes four light sources 111 (X,Y,Z) (Z=1 to 4). For example, the LED substrate 110 (1,1) includes a light source 111 (1,1,1), a light source 111 (1,1,2), a light source 111 (1,1,3), and a light source 111 (1,1,4). Z is a value indicating a horizontal position of the light source 111 and is a value which becomes Z=1 at the position of the leftmost light source 111 and which increases as the position advances toward the right side.

FIG. 2 is a block diagram illustrating an example of a configuration of the backlight apparatus.

Since ten LED substrates 110 have the same configuration, the LED substrate 110 (1,1) will be described as an example. The LED substrate 110 (1,1) includes light sources 111 (1,1,1) to 111 (1,1,4). The light sources 111 (1,1,1) to 111 (1,1,4) are driven by LED drivers 120 (1,1,1) to 120 (1,1,4), respectively.

In the present embodiment, an emission brightness adjustment process for suppressing a brightness unevenness occurring due to a fluctuation of temperature and the degree of aging between the light sources 111 is performed periodically or at predetermined points in time. All light sources 111 emit light during a normal operation. In the emission brightness adjustment process, a plurality of light sources are sequentially selected, and individual light source lighting-control is performed such that emission brightness of light sources other than the selected light source is temporarily reduced so that only the light (in the present embodiment, reflection light) from the selected light source is detected by the optical sensor 113. Moreover, the emission brightness of the respective light sources 111 is adjusted based on the optical detection value of each light source. The emission brightness adjustment process (including the individual light source lighting-control) is performed by a microcomputer 125 described later.

In the present embodiment, an example in which the individual light source lighting-control is a process of temporarily implementing turning off of the light sources other than the selected light source has been described. However, the present invention is not limited to this. For example, the light sources other than the selected light source may be lit with emission brightness that does not affect the optical detection value.

In the present embodiment, an example in which the optical detection value is used for adjusting the emission brightness has been described. However, the purpose of the optical detection value is not limited to this. For example, the optical detection value may be used by other image display apparatuses.

FIG. 2 illustrates a lit state when an optical detection process of obtaining an optical detection value indicating the light from the light source 111 (1,1,1). In FIG. 2, the light source 111 (1,1,1) is lit and the other light sources 111 are forcibly unlit. The most part of the light 121 (1,1,1) emitted from the light source 111 (1,1,1) enters the color liquid crystal panel 105 (not illustrated in FIG. 2). However, a portion of the light 121 (1,1,1) is returned from the optical sheet 106 (not illustrated in FIG. 2) toward the light source as reflection light and enters the respective optical sensors 113. Each optical sensor 113 outputs an analog value 122 (optical detection value) indicating brightness according to the brightness of the detected reflection light. An A/D converter 123 selects an analog value 122 (1,1,1) output by the optical sensor 113 (1,1,1) correlated with the light source 111 (1,1,1) among the analog values 122 output by the respective optical sensors 113. Moreover, the A/D converter 123 converts the selected analog value to a digital value and outputs a digital value 124 to the microcomputer 125.

The same process is performed on the other light sources 111. That is, the reflection light is detected by the respective optical sensors 113 in a state where only the light source 111 which is the subject of the optical detection process is lit. Moreover, the analog value 122 of the optical sensor 113 correlated with the light source 111 which is the subject of the optical detection process is converted to the digital value 124 by the A/D converter 123, and the digital value 124 is output to the microcomputer 125. Thus, forty optical detection values (digital values 124) in total are output from the A/D converter 123 to the microcomputer 125.

The microcomputer 125 adjusts the emission brightness of the light source 111 based on the optical detection value (specifically, the digital value 124) of the optical sensor 113. In the present embodiment, the microcomputer 125 adjusts the emission brightness of a light source based on the optical detection value of each light source. Specifically, target brightness values (target detection values) of the respective light sources 111 determined during a manufacturing test or the like of a color image display apparatus are recorded in advance in a nonvolatile memory 126. The microcomputer 125 compares an optical detection value of each light source 111 with a target brightness value of the light source. The microcomputer 125 adjusts the emission brightness of the respective light sources 111 according to the result of the comparison so that the optical detection value is identical to the target brightness value. The emission brightness is adjusted by adjusting a LED driver control signal 127 that is output from the microcomputer 125 to the LED driver 120, for example. The LED driver 120 drives the light source 111 according to the LED driver control signal. The LED driver control signal indicates a pulse width of a pulse signal (current or voltage pulse signal) applied to the light source 111, for example. In this case, the LED driver control signal is adjusted whereby the emission brightness of the light source 111 is subjected to PWM control. The LED driver control signal is not limited to this. For example, the LED driver control signal may be a peak value of the pulse signal applied to the light source 111 and may be both the pulse width and the peak value. By adjusting the emission brightness of the respective light sources 111 so that the optical detection value is identical to the target brightness value, it is possible to suppress a brightness unevenness of the entire backlight apparatus.

In the present embodiment, the emission surface region of the light source substrate 101 is divided into a plurality of emission areas. In other words, the emission surface region includes a plurality of emission areas. The plurality of light sources 111 is disposed so that at least two light sources 111 are disposed in each of the plurality of emission areas.

Figure 3A:
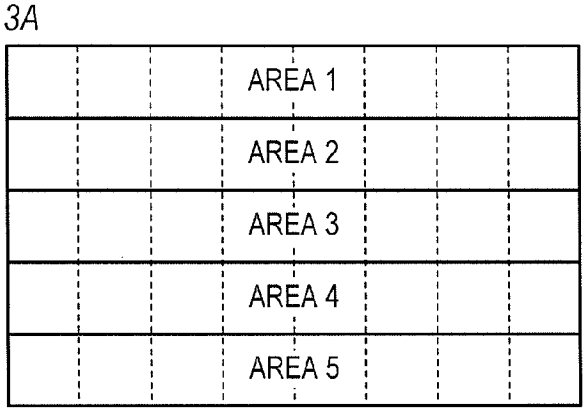
FIGS. 3A and 3B are diagrams illustrating an example of emission control of the backlight apparatus according to the present embodiment.

FIG. 3A is a schematic diagram illustrating an example of emission areas of the light source substrate 101 when seen from the front direction (the color liquid crystal panel 105).

In the example of FIG. 3A, the emission surface region is divided into five Areas 1 to 5.

Eight light sources in total including the light sources 111 (1,1,1) to 111 (1,1,4) and the light sources 111 (1,2,1) to 111 (1,2,4) are disposed in Area 1.

Eight light sources 111 of which the vertical positions are the same are disposed in Areas 2 to 5.

In the present embodiment, in a normal period, the respective light sources 111 are subjected to PWM control so that a plurality of emission areas emits light periodically at different phases. Specifically, the plurality of light sources (eight light sources in the example of FIG. 3A) disposed in the same emission area is subjected to PWM control so that the light sources start being lit at the same time. Moreover, the respective light sources are subjected to PWM control so that the lighting start time is different between emission areas. In the example of FIG. 3A, the respective light sources 111 are subjected to PWM control so that lighting starts sequentially in the order of Area 1, Area 2, Area 3, Area 4, and Area 5.

Figure 3B:
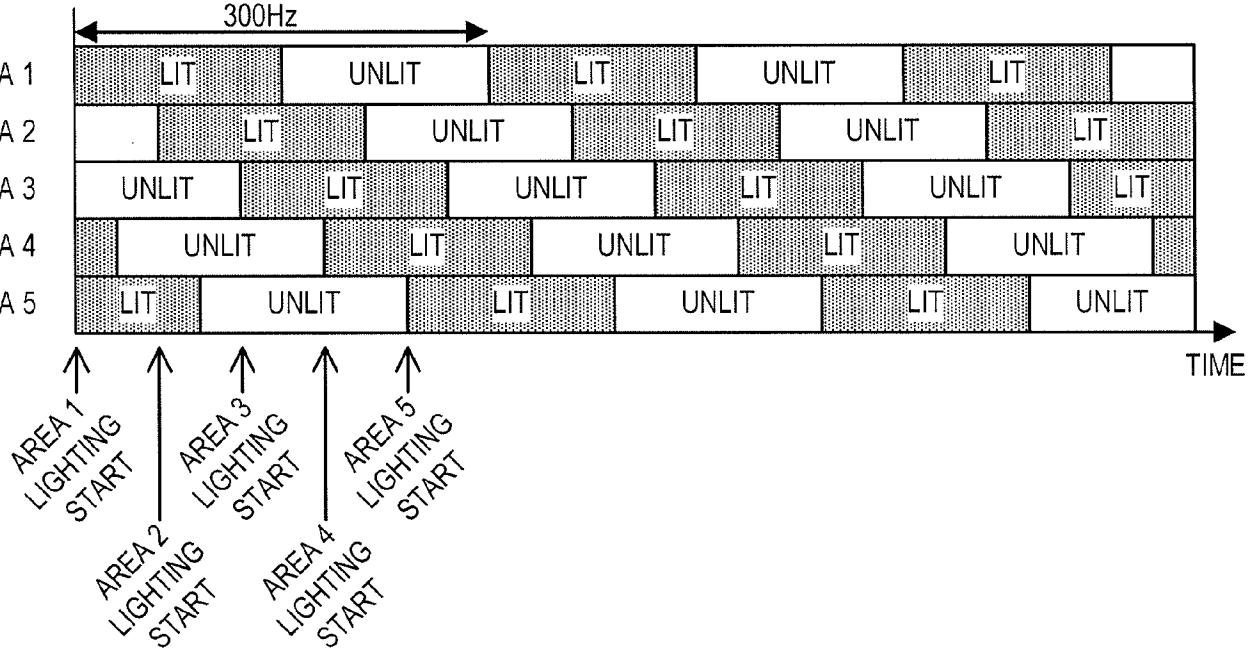

FIG. 3B is a timing diagram illustrating a change over time in lighting and extinguishing timing of the respective emission areas on the basis of PWM control.

The light sources 111 in the respective emission areas are controlled to be lit and unlit at such a sufficiently high frequency (in this example, 300 Hz) that users cannot perceive a flicker effect. The areas start lighting in the order of Area 1 to Area 5. Moreover, the interval between a lighting start timing of an emission area and a lighting start timing of the next emission area is constant. Specifically, when Area 1 starting light, Area 2 starts lighting after 1/1500seconds (=1/300seconds divided by 5). Further, Area 3, Area 4, and Area 5 start lighting after 1/1500 seconds, 2/1500 seconds, and 3/1500 seconds, respectively. Moreover, Area 1 starts lighting again after 1/1500 seconds from the lighting start timing of Area 5. Such lighting and extinguishing-control is repeatedly performed.

As illustrated in FIG. 3B, when the duty ratio (emission brightness) of the respective areas by the PWM control is 50%, the lighting ending (extinguishing start) timing of Area 1 occurs 1/600 seconds (=1/300 seconds×0.5) after the lighting start timing of Area 1. Further, Area 2, Area 3, Area 4, and Area 5 end lighting (start extinguishing) after elapse of 1/1500 seconds, 2/1500 seconds, 3/1500 seconds, and 4/1500 seconds, respectively. The duty ratio is the ratio of a total lighting period in one cycle to one emission cycle.

For the sake of simplicity, in FIG. 3B, although the duty ratio of all light sources 111 is 50%, the duty ratios of the light sources 111 maybe different when the emission brightness adjustment process is performed.

Moreover, for the sake of simplicity, FIG. 3B illustrates an example in which one lighting period and one extinguishing period are set in one emission cycle. However, a plurality of lighting periods and a plurality of extinguishing periods may be set in one emission period.

Figures 4A, 4B, 4C, 4D:
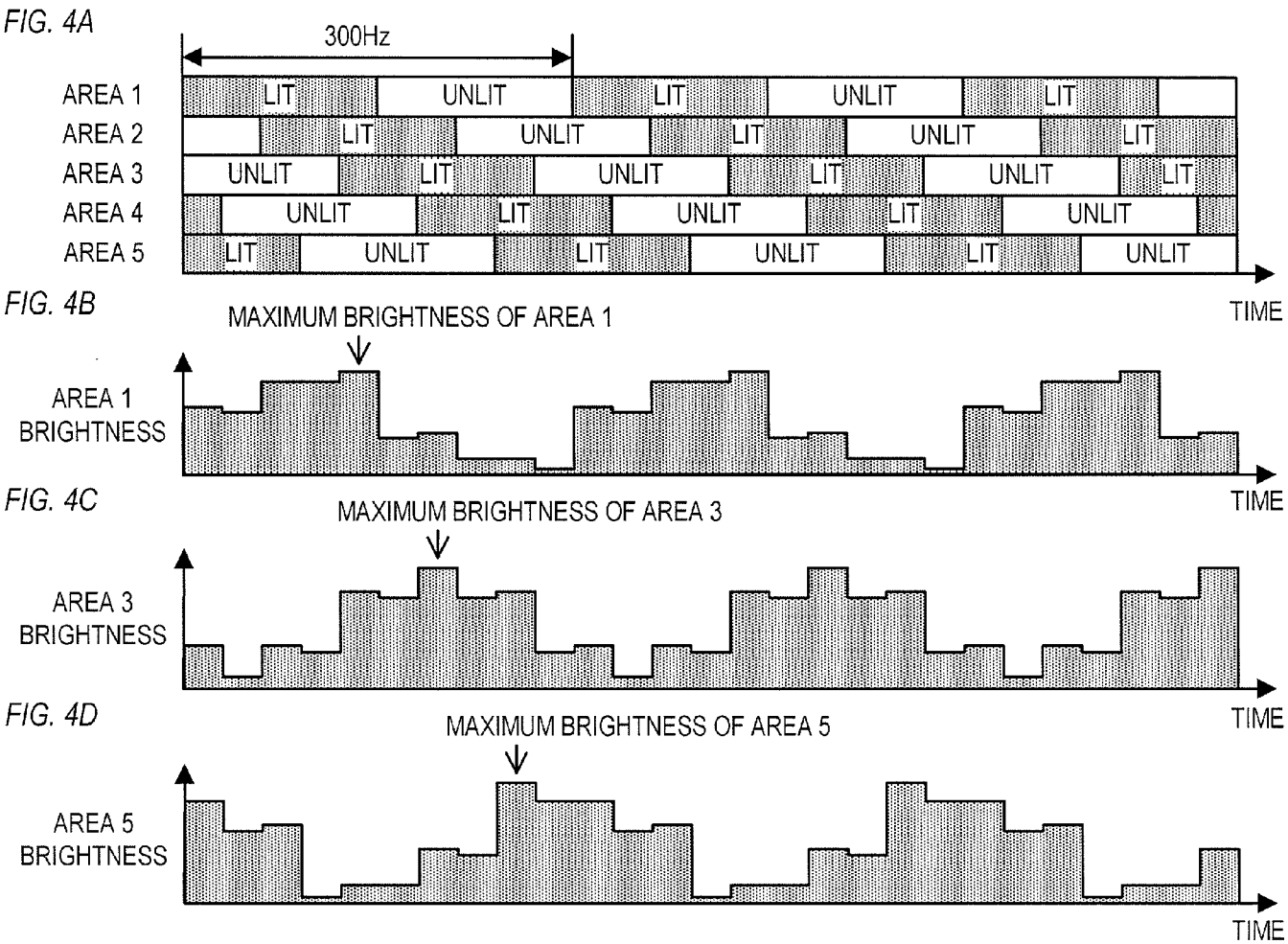
FIGS. 4A to 4D are diagrams illustrating an example of a brightness variation in the backlight apparatus according to the present embodiment.

FIG. 4A is a timing diagram illustrating a change overtime in lighting and extinguishing timing of respective emission areas and is the same diagram as FIG. 3B. FIG. 4B is a timing diagram illustrating the relation of changes over time in brightness of Area 1. FIG. 4C is a timing diagram illustrating the relation of changes over time in brightness of Area 3. FIG. 4D is a timing diagram illustrating the relation of changes overtime in brightness of Area 5. In FIGS. 4A to 4D, the horizontal axis represents time.

Although the brightness of Area 1 is influenced greatly by emission of Area 1, the brightness is also influenced by emission of other areas. A period of lighting Areas 2 and 3 close to Area 1 is present in the lighting period of Area 1, and the brightness of Area 1 reaches its maximum in this period. Moreover, a period of extinguishing Areas 1 to 3 and lighting Areas 4 and 5 distant from Area 1 is present, and the brightness of Area 1 reaches its minimum in this period.

Similarly to the changes overtime in the brightness of Area 1, a period of lighting Areas 2 and 4 close to Area 3 is present in the lighting period of Area 3, and the brightness of Area 3 reaches its maximum in this period.

Similarly to the changes over time in the brightness of Areas 1 and 3, a period of lighting Areas 3 and 4 close to Area 5 is present in the lighting period of Area 5, and the brightness of Area 5 reaches its maximum in this period.

Although the changes over time in the brightness of Areas 2 and 4 are not described, there is also a point in time when the brightness of Areas 2 and 4 reaches its maximum. The point in time when the brightness of Area 2 reaches its maximum occurs between the point in time when the brightness of Area 1 reaches its maximum and the point in time when the brightness of Area 3 reaches its maximum. The point in time when the brightness of Area 4 reaches its maximum occurs between the point in time when the brightness of Area 3 reaches its maximum and the point in time when the brightness of Area 5 reaches its maximum.

As can be understood from the above description, the points in time when the brightness of the respective emission areas reaches its maximum occur in the order of Area 1 to Area 5. Due to this, the light source substrate 101 emits light so that a high brightness area scans in the top-to-bottom direction of the screen. Such scan emission has two merits. One is that changes over time in the power load due to lighting and extinguishing are smoothed. The other is that, with image rewriting of the color liquid crystal panel 105 being also performed by scanning in the top-to-bottom direction of the screen, if the emission of the backlight apparatus scans in the same direction, a displayed image (image displayed on the screen) is stabilized.

Next, the flow of individual light source lighting-control will be described. In the present embodiment, such control that light sources other than the selected light source are temporarily unlit during a normal emission (periodic emission) period is performed as the individual light source lighting-control.

First, the flow in which a flicker effect is perceived by users will be described.

FIG. 5A is a list table illustrating the orders of light sources 111 selected as the subject of individual light source lighting-control. The individual light source lighting-control (specifically, a process in which the microcomputer 125 performs individual light source lighting-control and the optical detection value obtained by the A/D converter 123 is output to the microcomputer 125) is performed by the same number of times (forty times) as the number of light sources 111. Forty times of individual light source lighting-control may be performed continuously and repeatedly on forty light sources.

In the first process, the light source 111 (1,1,1) is lit and the other light sources 111 are unlit. The optical detection value of the optical sensor 113 (1,1,1) corresponding to the light sources 111 (1,1,1) is input to the microcomputer 125.

In the second process, the light source 111 (1,1,2) is lit and the other light sources 111 are unlit. The optical detection value of the optical sensor 113 (1,1,2) corresponding to the light source 111 (1,1,2) is input to the microcomputer 125.

The third and subsequent processes are performed in the same manner according to the list table of FIG. 5A, which will not be described.

FIG. 5B is a schematic diagram illustrating the relation between the selection order in the list table of FIG. 5A and the position of a light source when seen from the front direction (the color liquid crystal panel 105).

In the first to eighth processes, eight light sources 111 of Area 1 are selected sequentially from the left as the individual lighting-control target light sources.

In the ninth to sixteenth processes, eight light sources 111 of Area 2 are selected sequentially from the left as the individual lighting-control target light sources.

In the seventeenth to twenty fourth processes, eight light sources 111 of Area 3 are selected sequentially from the left as the individual lighting-control target light sources.

In the twenty fifth to thirty second processes, eight light sources 111 of Area 4 are selected sequentially from the left as the individual lighting-control target light sources.

In the thirty third to fortieth processes, eight light sources 111 of Area 5 are selected sequentially from the left as the individual lighting-control target light sources.

Here, brightness variations in respective emission areas occurring due to individual light source lighting-control will be described in detail. Although a brightness variation occurs in all emission areas, a brightness variation in Area 3 will be described as a representative example.

Figure 6A:
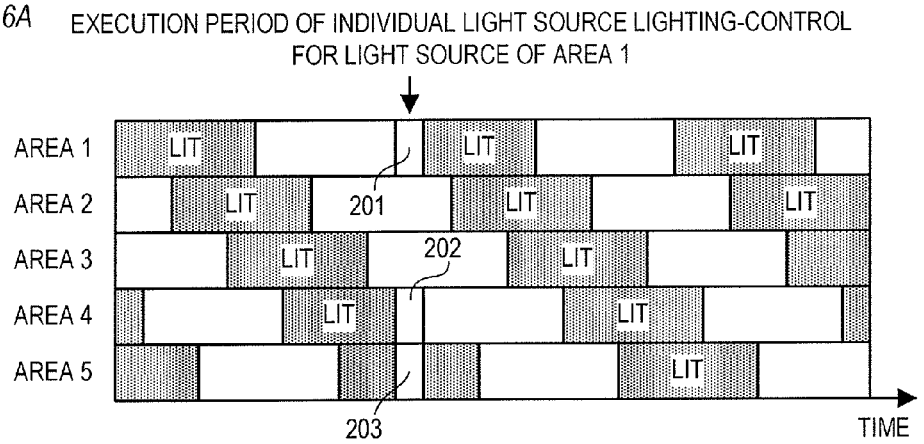
FIGS. 6A to 6D are diagrams illustrating an example of a brightness decrease caused by individual light source lighting-control.

FIG. 6A is a timing diagram illustrating the timings when individual light source lighting-control is performed on the light sources 111 disposed in Area 1. The horizontal axis of FIG. 6A represents time.

In the present embodiment, individual light source lighting-control on a light source starts when the light source starts emitting light. Due to this, the start time of individual light source lighting-control on the light source 111 (for example, the light source 111 (1,1,1)) of Area 1 is set as lighting start time of Area 1. In order to detect light from the light source 111 disposed in Area 1, the light source 111 needs to emit light. Since the start time of individual light source lighting-control is set to the emission start time of Area 1, it is possible to easily set the start time of the individual light source lighting-control regardless of the duty ratio. Moreover, since it is not necessary to set a new lighting period for the light source subjected to the individual light source lighting-control, it is possible to prevent an occurrence of a brightness variation due to the setting of anew lighting period.

In the period of performing individual light source lighting-control on the light source 111 of Area 1, the light sources 111 (other light sources 111 of Area 1 and the light sources 111 of Areas 2 to 5) other than the light source subjected to individual light source lighting-control are unlit.

Due to this, a new extinguishing period 201 is set for light sources 111 other than the lighting-control target light source among the light sources 111 of Area 1.

When normal emission (periodic emission) of light is performed, the light sources 111 of Areas 2 and 3 are unlit in a period where individual light source lighting-control is performed on the light source 111 of Area 1. Due to this, a new extinguishing period is not set for the light sources of Areas 2 and 3.

A new extinguishing period 202 is set for the light source 111 of Area 4. Moreover, a new extinguishing period 203 is set for the light source of Area 5.

The extinguishing periods 201 to 203 are the same period as the period where individual light source lighting-control is performed on the light source 111 of Area 1.

Figure 6B:
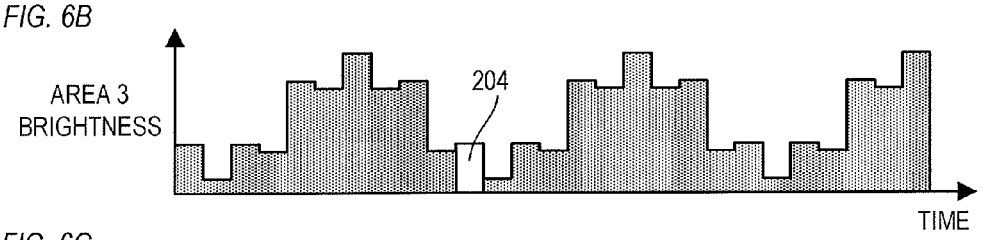

FIG. 6B is a timing diagram illustrating a brightness variation in Area 3. The horizontal axis of FIG. 6B represents time similarly to FIG. 6A.

Although the brightness of Area 3 is influenced greatly by emission of Area 3, the brightness is also influenced by emission of other areas. As described above, in the period where individual light source lighting-control is performed on the light source 111 of Area 1, new extinguishing periods 201, 202, and 203 for Areas 1, 4, and 5 are also created. Due to this, in the period where the individual light source lighting-control is performed on the light source 111 of Area 1, a brightness decrease due to the setting of the new extinguishing periods 201 to 203 occurs in Area 3. Specifically, a brightness decrease corresponding to a brightness decrease amount 204 occurs. However, in the period where individual light source lighting-control is performed on the light source 111 of Area 1, the lit state of Area 3 is not changed from "Unlit" and the lit state of Area 2 adjacent to Area 3 is not changed from "Unlit". Thus, the brightness decrease amount 204 is a small value. In FIG. 6B, for the sake of simplicity, a brightness decrease amount at which the brightness of Area 3 is decreased to zero is illustrated with the brightness decrease amount being 204, but the brightness of Area 3 in fact exhibits a value larger than zero. Specifically, in the period where individual light source lighting-control is performed on the light source 111 of Area 1, since the individual light source lighting-control target light source 111 is lit and the light from the individual light source lighting-control target light source 111 leaks into Area 3, the brightness of Area 3 has a value larger than zero.

Figure 6C:
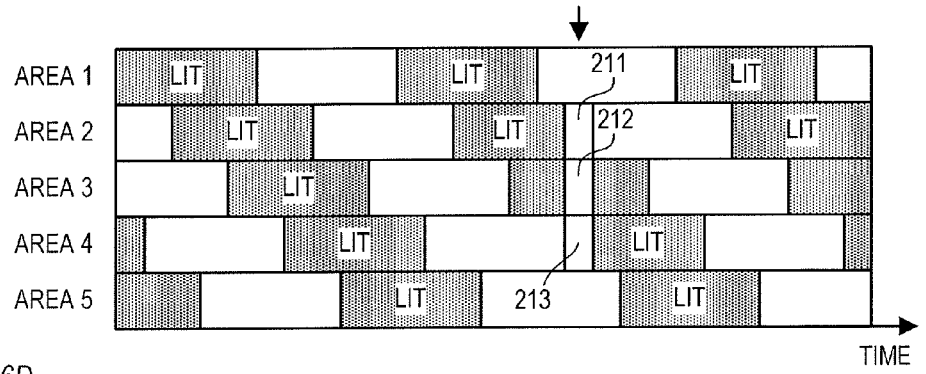

FIG. 6C is a timing diagram illustrating the timings when individual light source lighting-control is performed on the light sources 111 disposed in Area 4. The horizontal axis of FIG. 6C represents time.

The start time of individual light source lighting-control on the light source 111 (for example, the light source 111 (4,1,1)) of Area 4 is set as lighting start time of Area 4 similarly to the start time of individual light source lighting-control on the light source 111 of Area 1.

A new extinguishing period 213 is set for light sources 111 other than the individual light source lighting-control target light source among the light sources 111 of Area 4.

When normal emission (periodic emission) is performed, the light sources 111 of Areas 1 and 5 are unlit in a period where individual light source lighting-control is performed on the light source 111 of Area 4. Due to this, a new extinguishing period is not set for the light sources of Areas 1 and 5.

A new extinguishing period 211 is set for the light source 111 of Area 2. Moreover, anew extinguishing period 212 is set for the light source of Area 3.

The extinguishing periods 211 to 213 are the same period as the period where individual light source lighting-control is performed on the light source 111 of Area 4.

Figure 6D:
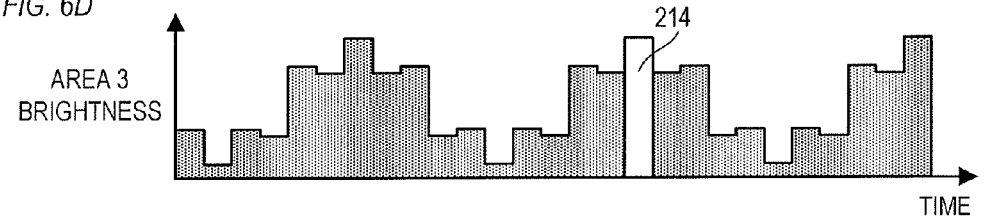

FIG. 6D is a timing diagram illustrating a brightness variation in Area 3. The horizontal axis of FIG. 6D represents time similarly to FIG. 6C.

As described above, in the period where individual light source lighting-control is performed on the light source 111 of Area 4, new extinguishing periods 211, 212, and 213 for Areas 2, 3, and 4 occur also. Due to this, in the period where the individual light source lighting-control is performed on the light source 111 of Area 4, a brightness decrease due to the setting of the new extinguishing periods 211 to 213 occurs in Area 3. Specifically, a brightness decrease corresponding to a brightness decrease amount 214 occurs. Here, the influence of emission of Area 3 on the brightness of Area 3 is large, and the influence of emission of Areas 2 and 4 adjacent to Area 3 on the brightness of Area 3 is also large. Thus, the brightness decrease amount 214 is a very large value.

FIG. 7 is a list table illustrating a brightness decrease amount due to individual light source lighting-control. In FIG. 7, a brightness decrease amount of an emission area due to individual light source lighting-control on the light source of the emission area is illustrated for each emission area.

In Area 1, a maximum brightness decrease (brightness decrease amount of 100) occurs when individual light source lighting-control is performed on the light source of Area 3. Moreover, a brightness decrease (brightness decrease amount of 65) occurs when individual light source lighting-control is performed on the light source of Area 1, and a brightness decrease (brightness decrease amount of 90) occurs when individual light source lighting-control is performed on the light source of Area 2. Moreover, a brightness decrease (brightness decrease amount of 40) occurs when individual light source lighting-control is performed on the light source of Area 4, and a brightness decrease (brightness decrease amount of 15) occurs when individual light source lighting-control is performed on the light source of Area 5. In this manner, the brightness decrease amount of an emission area changes greatly from emission area to emission area in which a lighting-control target light source is disposed.

Although the brightness decrease amount of Areas 2 to 5 is not described, the brightness decrease amount of these emission areas also changes greatly from emission area to emission area in which an individual light source lighting-control target light source is disposed similarly to the brightness decrease amount of Area 1.

Figures 8A, 8B, 8C:
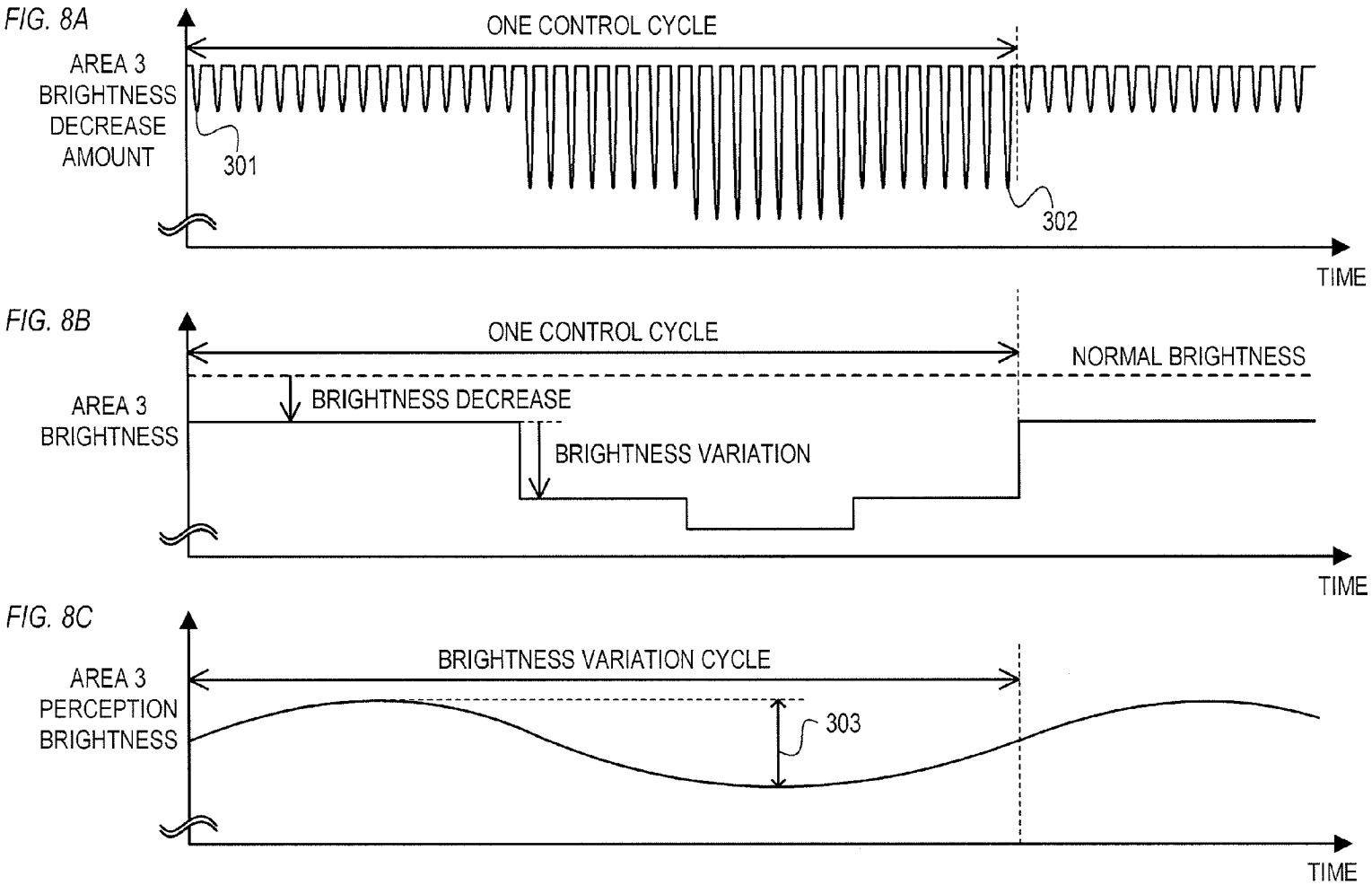
FIGS. 8A to 8C are diagrams illustrating an example of problems of the present embodiment.

FIG. 8A is a timing diagram illustrating a brightness decrease amount of Area 3 when individual light source lighting-control is performed according to a selection order in the list table of FIG. 5A.

In one cycle (one control cycle) of individual light source lighting-control, individual light source lighting-control is performed forty times in total. Since individual light source lighting-control on the light source of Area 1 is performed in the first process 301, a brightness decrease amount of Area 3 is as small as 35 as illustrated in FIG. 7. Since individual light source lighting-control on the light source of Area 1 is also performed in the second to eighth processes, a brightness decrease amount of Area 3 is as small as 35. Moreover, in the ninth to sixteenth processes where individual light source lighting-control on the light source of Area 2 is performed, the brightness decrease amount of Area 3 is as small as 35. Since individual light source lighting-control on the light source of Area 3 is performed in the seventeenth to twenty fourth processes, a brightness decrease amount of Area 3 is as large as 80. Since individual light source lighting-control on the light source of Area 4 is performed in the twenty fifth to thirty second processes, a brightness decrease amount of Area 3 is 100 which is the maximum value. Moreover, since individual light source lighting-control on the light source of Area 5 is performed in the thirty third to fortieth processes 302, a brightness decrease amount of Area 3 is as large as 80. After that, the process is repeated from the first process.

FIG. 8B is a diagram illustrating a brightness of Area 3 in a case where a brightness decrease as illustrated in FIG. 8A occurs when emission areas emit light as illustrated in FIG. 3B. FIG. 8B illustrates brightnesses in each emission cycle (1/300 seconds in the present embodiment). In FIG. 8B, a broken line indicates a brightness (normal brightness) when individual light source a brightness variation does not occur when individual light source lighting-control is not performed. However, when individual light source lighting-control is performed, a brightness decrease illustrated in FIG. 8A occurs. As a result, the brightness of Area 3 varies as illustrated in FIG. 8B.

FIG. 8C is a timing diagram illustrating a perception brightness perceived by users (persons) when the brightness variation of FIG. 8B is seen by users.

Human eyes have characteristics functioning similarly to a lowpass filter (LPF) applied to a brightness variation. Due to this, it is said that the sensitivity to a brightness variation at frequencies lower than 60 Hz is high and the sensitivity to a brightness variation at a frequency of approximately 15 Hz is the highest. Thus, a brightness variation at frequencies lower than 60 Hz may be perceived by users as a flicker. On the other hand, a brightness variation at frequencies of 60 Hz or higher is rarely perceived by users as a flicker. Moreover, the smaller the amplitude of a brightness variation, the harder the brightness variation is perceived as a flicker.

When such a brightness variation as illustrated in FIG. 8B occurs, a variation cycle of the perception brightness perceived by users becomes too long as illustrated in FIG. 8C. In other words, a variation frequency of the perception brightness becomes extremely small. Specifically, when forty times of individual light source lighting-control in total is performed every 1/300 seconds according to the selection order in the list table of FIG. 5A, the variation cycle of the perception brightness becomes 1/300 seconds×40=1/7.5 seconds. In other words, a variation frequency of the perception brightness becomes 7.5 Hz which is a frequency that is likely to be perceived as a flicker. Moreover, a variation amplitude 303 of the perception brightness also becomes a large value.

Although the perception brightness of Area 3 has been described, a variation of the perception brightness perceived as a flicker occurs in other areas similarly to Area 3.

As described above, when individual light source lighting-control is performed according to the selection order in the list table of FIG. 5A, a flicker is perceived by users.

Hereinafter, the procedure (the procedure of performing individual light source lighting-control) in which a flicker is rarely perceived by users will be described.

FIG. 9A is a list table illustrating an example of the order of light sources selected as the subject of individual light source lighting-control. According to the list table of FIG. 5A, eight light sources 111 in the same area are selected continuously. According to the list table of FIG. 9A, an individual light source lighting-control target light source is selected in such an order that individual light source lighting-control is not continuously performed on the light sources disposed in the same emission area. Specifically, a process of performing individual light source lighting-control one at a time sequentially on the light sources of Areas 1, 2, 3, 4, and 5 is repeatedly performed.

In the first process, individual light source lighting-control is performed on the light source 111 (1,1,1).

In the second process, individual light source lighting-control is performed on the light source 111 (2,1,1).

In the third process, individual light source lighting-control is performed on the light source 111 (3,1,1).

In the fourth process, individual light source lighting-control is performed on the light source 111 (4,1,1).

In the fifth process, individual light source lighting-control is performed on the light source 111 (5,1,1).

In the sixth process, individual light source lighting-control is performed again on the light source 111 of Area 1. Specifically, individual light source lighting-control is performed on the light source 111 (1,1,2).

Subsequent individual light source lighting-control will not be described.

FIG. 9B is a schematic diagram illustrating the relation between the selection order in the list table of FIG. 9A and the position of a light source when seen from the front direction (the color liquid crystal panel 105).

In the first to fifth processes, five light sources 111 at the left end of Areas 1 to 5 are sequentially selected. That is, five light sources at the left end are selected as individual lighting-control target light sources sequentially in the top-to-bottom direction.

In the sixth to tenth processes, five light sources on the second line from the left are selected as individual lighting-control target light sources sequentially in the top-to-bottom direction.

In the eleventh to fifteenth processes, five light sources on the third line from the left are selected as individual lighting-control target light sources sequentially in the top-to-bottom direction.

In the sixteenth to twentieth processes, five light sources on the fourth line from the left are selected as individual lighting-control target light sources sequentially in the top-to-bottom direction.

In the twenty first to twenty fifth processes, five light sources on the fifth line from the left are selected as individual lighting-control target light sources sequentially in the top-to-bottom direction.

In the twenty sixth to thirtieth processes, five light sources on the sixth line from the left are selected as individual lighting-control target light sources sequentially in the top-to-bottom direction.

In the thirty first to thirty fifth processes, five light sources on the seventh line from the left are selected as individual lighting-control target light sources sequentially in the top-to-bottom direction.

In the thirty sixth to fortieth processes, five light sources at the right end (on the eighth line from the left) are selected as individual lighting-control target light sources sequentially in the top-to-bottom direction.

Figures 10A, 10B, 10C:
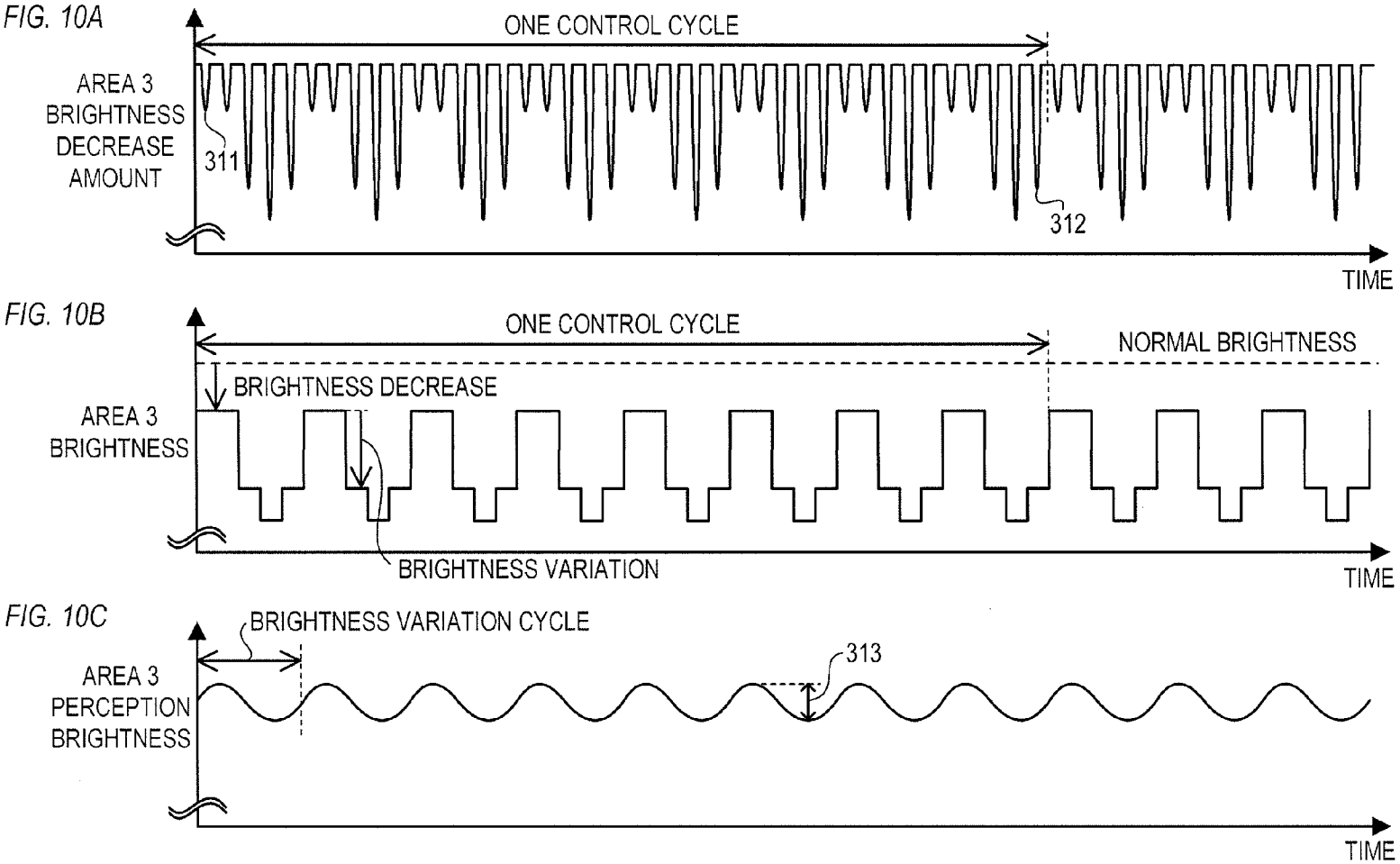
FIGS. 10A to 10C are diagrams illustrating an example of the effects of the present embodiment.

FIG. 10A is a timing diagram illustrating a brightness decrease amount of Area 3 when individual light source lighting-control is performed according to the selection order in the list table of FIG. 9A.

In one cycle (one control cycle) of individual light source lighting-control, individual light source lighting-control is performed forty times in total. Since individual light source lighting-control on the light source of Area 1 is performed in a first process 311, a brightness decrease amount of Area 3 is as small as 35 as illustrated in FIG. 7. Since individual light source lighting-control on the light source of Area 2 is performed in the second process, a brightness decrease amount of Area 3 is as small as 35. Moreover, since individual light source lighting-control on the light source of Area 3 is performed in the third process, the brightness decrease amount of Area 3 is as large as 80. Since individual light source lighting-control on the light source of Area 4 is performed in the fourth process, a brightness decrease amount of Area 3 is 100 which is the maximum value. Since individual light source lighting-control on the light source of Area 5 is performed in the fifth process, a brightness decrease amount of Area 3 is as large as 80. After that, the same brightness decrease as the brightness decrease from the first to fifth processes occurs repeatedly seven times in total during the sixth to fortieth processes 312. After that, the process is repeated from the first process.

FIG. 10B is a diagram illustrating a brightness of Area 3 in a case where a brightness decrease as illustrated in FIG. 10A occurs when emission areas emit light as illustrated in FIG. 3B. FIG. 10B illustrates brightnesses in each emission cycle (1/300 seconds in the present embodiment). In FIG. 10B, a broken line indicates a brightness (normal brightness) when lighting-control is not performed. As illustrated in FIG. 10B, a brightness variation does not occur when individual light source lighting-control is not performed. However, when individual light source lighting-control is performed, a brightness decrease illustrated in FIG. 10A occurs. As a result, the brightness of Area 3 varies as illustrated in FIG. 10B.

FIG. 10C is a timing diagram illustrating a perception brightness perceived by users (persons) when the brightness variation of FIG. 10B is seen by users.

When such a brightness variation as illustrated in FIG. 10B occurs, a variation cycle of the perception brightness perceived by users becomes sufficiently short as illustrated in FIG. 10C. In other words, a variation frequency of the perception brightness becomes sufficiently small. Specifically, when forty times of individual light source lighting-control in total is performed every 1/300 seconds according to the selection order in the list table of FIG. 9A, the variation cycle of the perception brightness becomes 1/300 seconds×5=1/60 seconds. In other words, a variation frequency of the perception brightness becomes 60 Hz which is a frequency that is rarely perceived as a flicker. Moreover, a variation amplitude 313 of the perception brightness also becomes a small value, and a flicker is more rarely perceived.

As described above, according to the present embodiment, an individual light source lighting-control target light source is selected in such an order that individual light source lighting-control is not continuously performed on the light sources disposed in the same emission area. Due to this, individual light source lighting-control is performed sequentially on a plurality of light sources, whereby the flicker perceived by users can be suppressed.

Although an example in which a light source is selected in the order of Areas 1 to 5 is illustrated in FIG. 9A, a light source selection order is not limited to this. For example, the light source may be selected in the order of Areas 1, 3, 5, 2, and 4. Moreover, light sources may be selected in an optional order as long as individual lighting-control target light sources are selected in such an order that the frequency of a low-frequency component of the brightness variation in each of the plurality of emission areas is 60 Hz or higher. For example, individual light source lighting-control on light sources disposed in the same emission area may be performed continuously n times only as long as the frequency of a low-frequency component of the brightness variation in each of the plurality of emission areas is 60 Hz or higher. n is an integer of 1 or larger and is a value that is smaller than a total number of light sources disposed in the emission area.

In the present embodiment, although a light source selection order only has been focused on, a light source selection frequency (individual light source lighting-control frequency) maybe adjusted as well as the light source selection order. That is, individual lighting-control target light sources may be selected in such order and frequency that the frequency of a low-frequency component of the brightness variation in each of the plurality of emission areas is 60 Hz or higher. For example, when the number of emission areas is 10, individual lighting-control target light sources may be selected in such an order that individual light source lighting-control on light sources disposed in the same emission area is not performed continuously and individual light source lighting-control may be performed every 1/600 seconds. In this way, a perception brightness variation cycle of 1/600 seconds×10=1/60 seconds can be realized. That is, the perception brightness variation frequency of 60 Hz which is the frequency that variation is rarely perceived as a flicker can be realized.

In the example of FIG. 9A, light sources are sequentially selected from the light sources at the left end. However, since users are highly likely to focus on the center of an emission surface (screen), it is preferable to preferentially perform individual light source lighting-control on the light source close to the center of the emission surface and to preferentially adjust the emission brightness of the light source close to the center of the emission surface. In this way, it is possible to preferentially suppress a brightness change (a brightness change due to aging or change in temperature of light sources) at the center of the emission surface. Moreover, in an image display apparatus, it is possible to preferentially improve the image quality at the center of the screen. That is, it is possible to preferentially suppress a brightness change in a portion that users are likely to focus on and to preferentially improve the image quality of a portion that users are likely to focus on.

FIG. 11A is a list table illustrating an example of a selection order determined by taking the priority of individual light source lighting-control into consideration. Here, the priority of individual light source lighting-control may be, in other words, importance of image quality. FIG. 11A shows the order of priority in which the higher the priority, the lower the priority order.

In the list table of FIG. 11A, a priority order of 1 indicating the highest priority is set as a priority order of the fourth light source from the left and the fourth light source from the right (that is, the light source closest to the central position in the horizontal direction of the emission surface). Priority orders are set to other light sources so that the value increases as the position moves away from the central position in the horizontal direction of the emission surface. Specifically, a priority order of 2 is set as the priority order of the third light source from the left and the third light source from the right, and a priority order of 3 is set as the priority order of the second light source from the left and the second light source of the right. Moreover, a priority order of 2 indicating the lowest priority is set as a priority order of the light source at the left end and the light source at the right end.

According to the list table of FIG. 11A, individual lighting-control target light sources are selected in such an order that individual light source lighting-control is not continuously performed on light sources disposed in the same emission area. Further, individual lighting-control target light sources are selected in descending order of priorities of light sources (in ascending order of priority orders of light sources).

In the first process, individual light source lighting-control is performed on the light source 111 (1,1,4).

In the second process, individual light source lighting-control is performed on the light source 111 (2,1,4).

In the third process, individual light source lighting-control is performed on the light source 111 (3,1,4).

In the fourth process, individual light source lighting-control is performed on the light source 111 (4,1,4).

In the fifth process, individual light source lighting-control is performed on the light source 111 (5,1,4).

In the sixth process, individual light source lighting-control is performed again on the light source 111 of Area 1. Specifically, individual light source lighting-control is performed on the light source 111 (1,2,1).

Subsequent processes will not be described.

FIG. 11B is a schematic diagram illustrating the relation between the selection order in the list table of FIG. 11A and the position of a light source when seen from the front direction (the color liquid crystal panel 105).

In the first to fifth processes, five light sources 111 on the fourth line from the left of Areas 1 to 5 are sequentially selected. That is, five light sources on the fourth line from the left are selected as individual lighting-control target light sources sequentially in the top-to-bottom direction.

In the sixth to tenth processes, five light sources on the fourth line from the right are selected as individual lighting-control target light sources sequentially in the top-to-bottom direction.

In the eleventh to fifteenth processes, five light sources on the third line from the left are selected as individual lighting-control target light sources sequentially in the top-to-bottom direction.

In the sixteenth to twentieth processes, five light sources on the third line from the right are selected individual lighting-control target light sources sequentially in the top-to-bottom direction.

In the twenty first to twenty fifth processes, five light sources on the second line from the left are selected individual lighting-control target light sources sequentially in the top-to-bottom direction.

In the twenty sixth to thirtieth processes, five light sources on the second line from the right are selected individual lighting-control target light sources sequentially in the top-to-bottom direction.

In the thirty first to thirty fifth processes, five light sources at the left end are selected individual lighting-control target light sources sequentially in the top-to-bottom direction.

In the thirty sixth to fortieth processes, five light sources at the right end are selected individual lighting-control target light sources sequentially in the top-to-bottom direction.

A plurality of orders may be present in which the frequency o f a low-frequency component of the brightness variation of each of the plurality of emission areas is 60 Hz or higher. In such a case, it is preferable that individual lighting-control target light sources are selected in ascending order of the amplitudes of the low-frequency component of the plurality of orders. In particular, it is preferable that individual lighting-control target light sources are selected in such an order than the amplitude of the low-frequency component is minimized among the plurality of orders. In this way, it is possible to make a flicker more rarely perceived.

FIG. 12A is a diagram illustrating an example of a selection order capable of obtaining a low-frequency component having a smaller amplitude than the selection order of FIG. 9A.

In the example of FIG. 12A, a selection order is selected such that a continuous occurrence of small brightness decrease is limited as much as possible and that a continuous occurrence of a large brightness decrease is limited as much as possible.

In the first process, individual light source lighting-control is performed on the light source 111 (1,1,1).

In the second process, individual light source lighting-control is performed on the light source 111 (4,1,1).

In the third process, individual light source lighting-control is performed on the light source 111 (2,1,1).

In the fourth process, individual light source lighting-control is performed on the light source 111 (3,1,1).

In the fifth process, individual light source lighting-control is performed on the light source 111 (5,1,1).

In the sixth process, individual light source lighting-control is performed again on the light source 111 of Area 1. Specifically, individual light source lighting-control is performed on the light source 111 (1,2,1).

Subsequent processes will not be described.

FIG. 12B is a schematic diagram illustrating the relation between a selection order in the list table of FIG. 12A and the position of a light source when seen in the front direction (the color liquid crystal panel 105).

In the first process, the light source 111 of Area is selected as the individual light source lighting-control target light source. In the second process, the light source 111 of Area 4 is selected as the individual light source lighting-control target light source. In the third process, the light source 111 of Area is selected as the individual light source lighting-control target light source. In the fourth process, the light source 111 of Area 3 is selected as the individual light source lighting-control target light source. In the fifth process, the light source 111 of Area is selected as the individual light source lighting-control target light source. In the sixth to fortieth processes, a light source selecting process is repeatedly performed seven times in total in the same order as the first to fifth processes.

Figures 13A, 13B, 13C:
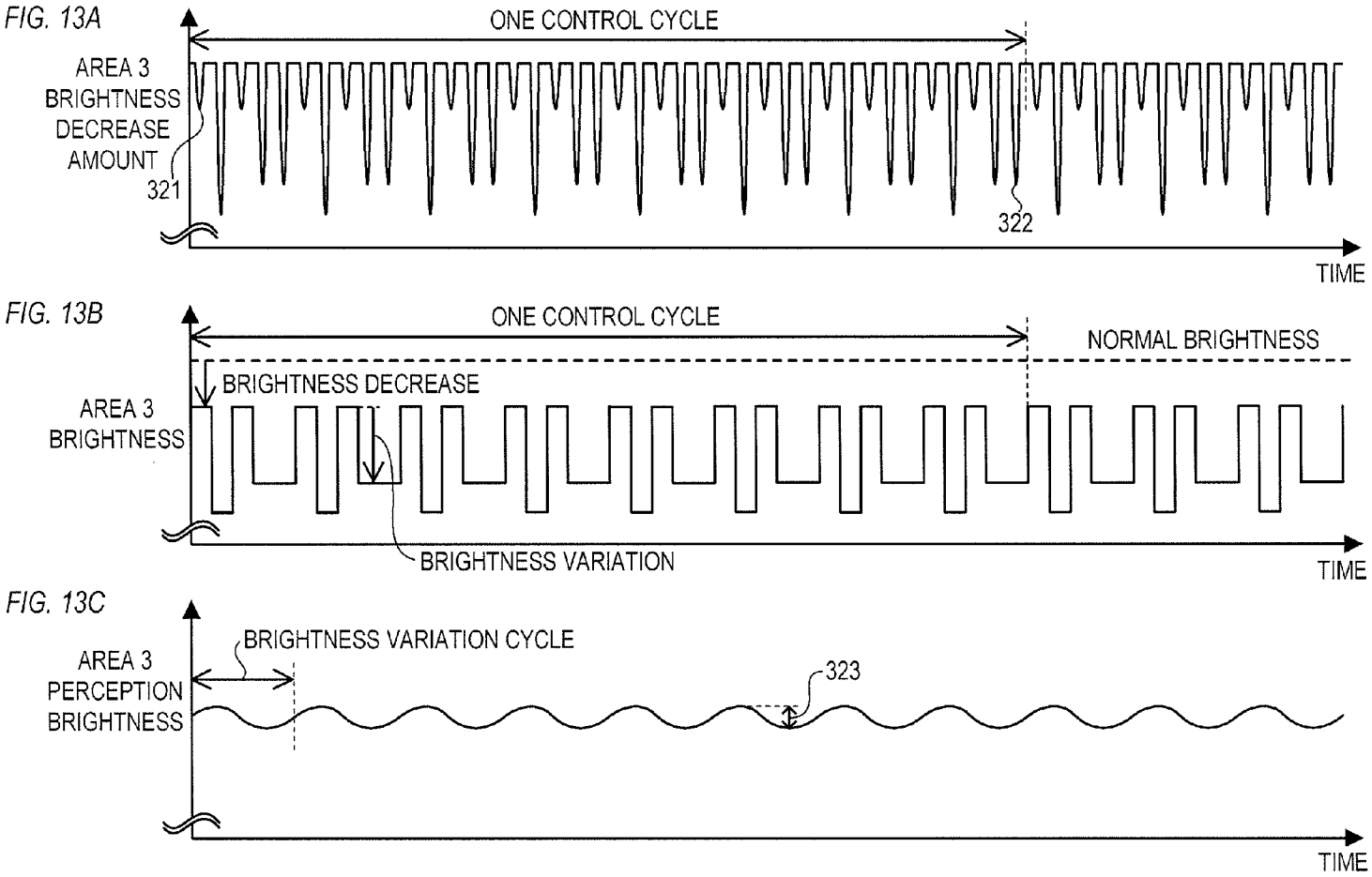
FIGS. 13A to 13C are diagrams illustrating an example of the effects of the present embodiment.

FIG. 13A is a timing diagram illustrating a brightness decrease amount of Area 3 when individual light source lighting-control is performed according to the selection order in the list table of FIG. 12A.

In one cycle (one control cycle) of individual light source lighting-control, individual light source lighting-control is performed forty times in total. Since individual light source lighting-control on the light source of Area 1 is performed in a first process 321, a brightness decrease amount of Area 3 is as small as 35 as illustrated in FIG. 7. Since individual light source lighting-control on the light source of Area 4 is performed in the second process, a brightness decrease amount of Area 3 is 100 which is the maximum value. Moreover, since individual light source lighting-control on the light source of Area 2 is performed in the third process, the brightness decrease amount of Area 3 is as small as 35. Since individual light source lighting-control on the light source of Area 3 is performed in the fourth process, a brightness decrease amount of Area 3 is as large as 80. Since individual light source lighting-control on the light source of Area 5 is performed in the fifth process, a brightness decrease amount of Area 3 is as large as 80. After that, the same brightness decrease as the brightness decrease from the first to fifth processes occurs repeatedly seven times in total during the sixth to fortieth processes 322. After that, the process is repeated from the first process.

FIG. 13B is a diagram illustrating a brightness of Area 3 in a case where a brightness decrease as illustrated in FIG. 13A occurs when emission areas emit light as illustrated in FIG. 3B. FIG. 13B illustrates brightnesses in each emission cycle (1/300 seconds in the present embodiment). In FIG. 13B, a broken line indicates a brightness (normal brightness) when individual light source lighting-control is not performed. As illustrated in FIG. 13B, a brightness variation does not occur when individual light source lighting-control is not performed. However, when individual light source lighting-control is performed, a brightness decrease illustrated in FIG. 13A occurs. As a result, the brightness of Area 3 varies as illustrated in FIG. 13B.

FIG. 13C is a timing diagram illustrating a perception brightness perceived by users (persons) when the brightness variation of FIG. 13B is seen by users.

When such a brightness variation as illustrated in FIG. 13B occurs, a variation cycle of the perception brightness perceived by users becomes sufficiently short as illustrated in FIG. 13C. In other words, a variation frequency of the perception brightness becomes sufficiently small. Specifically, when forty times of individual light source lighting-control in total is performed every 1/300 seconds according to the selection order in the list table of FIG. 12A, the variation cycle of the perception brightness becomes 1/300 seconds×5=1/60 seconds. In other words, a variation frequency of the perception brightness becomes 60 Hz which is a frequency that is rarely perceived as a flicker. Moreover, since individual lighting-control target light sources are selected in such an order that a continuous occurrence of a small brightness decrease is limited as much as possible and that a continuous occurrence of a large brightness decrease is limited as much as possible, the perception brightness variation amplitude 323 becomes a small value as compared to FIG. 10C. As a result, it is possible to make a flicker more rarely perceived.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s).

This application claims the benefit of Japanese Patent Application No. 2013-174600, filed on Aug. 26, 2013, which is hereby incorporated by reference herein in its entirety.

What is claimed is:

1. A light source apparatus comprising:

a light-emitting unit which includes a plurality of emission areas emitting light periodically at different phases and in which at least two light sources are disposed in each emission area;

a detection unit configured to detect light from the light-emitting unit;

a microprocessor configured to select the plurality of light sources of the light-emitting unit sequentially during the periodic light emission of the plurality of emission areas and to perform lighting-control of temporarily reducing emission brightness of light sources other than the selected light source so that light from the selected light source is detected by the detection unit; and a memory configured to store target brightness values for the respective light sources, wherein the microprocessor selects lighting-control target light sources so that lighting-control is sequentially performed on light sources disposed in different emission areas among the plurality of emission areas, and the microprocessor controls emission brightness of respective light sources based on the target brightness values stored in the memory and the detected result by the detection unit.

2. The light source apparatus according to claim 1, wherein the microprocessor selects the lighting-control target light sources in such an order that the lighting-control is not performed continuously on light sources disposed in the same emission area.

3. The light source apparatus according to claim 1, wherein the microprocessor selects the lighting-control target light sources in such an order that a frequency of a low-frequency component of a brightness variation in each of the plurality of emission areas is 60 Hz or higher.

4. The light source apparatus according to claim 1, wherein when a plurality of orders is present in which a frequency of a low-frequency component of a brightness variation in each of the plurality of emission areas is 60 Hz or higher, the microprocessor selects the lighting-control target light sources in such an order that an amplitude of the low-frequency component is minimized among the plurality of orders.

5. The light source apparatus according to claim 1, wherein the microprocessor selects the lighting-control target light sources in such an order and frequency that a frequency of a low-frequency component of a brightness variation in each of the plurality of emission areas is 60 Hz or higher.

6. The light source apparatus according to claim 1, wherein the lighting-control is control of temporarily implementing turning off of light sources other than the selected light source.

7. The light source apparatus according to claim 1, wherein the microprocessor starts the lighting-control on the light source when the light source starts emitting light.

8. The light source apparatus according to claim 1, wherein the microprocessor preferentially performs the lighting-control on a light source located close to the center of an emission surface.

9. A light source apparatus comprising:

a light-emitting unit which includes a plurality of emission areas emitting light periodically at different phases and in which at least two light sources are disposed in each emission area;

a detection unit which detects light from the light-emitting unit;

a microprocessor which selects the plurality of light sources of the light-emitting unit sequentially during the periodic light emission of the plurality of emission areas and performs lighting-control of temporarily reducing emission brightness of light sources other than the selected light source so that light from the selected light source is detected by the detection unit; and a memory configured to store target brightness values for the respective light sources, wherein the microprocessor selects lighting-control target light sources in such an order that a frequency of a low-frequency component of a brightness variation in each of the plurality of emission areas is 60 Hz or higher, and the microprocessor controls emission brightness of respective light sources based on the target brightness values stored in the memory and the detected result by the detection unit.

10. A method of controlling a light source apparatus including:

a light-emitting unit which includes a plurality of emission areas that emits light periodically at different phases and in which at least two light sources are disposed in each emission area; and a detection unit which detects light from the light-emitting unit, the method comprising:

a selecting step of selecting a plurality of light sources of the light-emitting unit sequentially; and a controlling step of performing lighting-control of temporarily reducing emission brightness of light sources other than the selected light source so that light from the selected light source is detected by the detection unit during the periodic light emission of the plurality of emission areas, wherein in the selecting step, the lighting-control target light sources are selected so that the lighting-control is sequentially performed on light sources disposed in different emission areas among the plurality of emission areas.

11. The method according to claim 10, wherein in the selecting step, the lighting-control target light sources are selected in such an order that the lighting-control is not performed continuously on light sources disposed in the same emission area.

12. The method according to claim 10, wherein in the selecting step, the lighting-control target light sources are selected in such an order that a frequency of a low-frequency component of a brightness variation in each of the plurality of emission areas is 60 Hz or higher.

13. The method according to claim 10, wherein when a plurality of orders is present in which a frequency of a low-frequency component of a brightness variation in each of the plurality of emission areas is 60 Hz or higher, in the selecting step, the lighting-control target light sources are selected in such an order that an amplitude of the low-frequency component is minimized among the plurality of orders.

14. The method according to claim 10, wherein in the selecting step, the lighting-control target light sources are selected in such an order and frequency that a frequency of a low-frequency component of a brightness variation in each of the plurality of emission areas is 60 Hz or higher.

15. The method according to claim 10, wherein the lighting-control is control of temporarily implementing turning off of light sources other than the selected light source.

16. The method according to claim 10, wherein in the controlling step, the lighting-control on the light source is started when the light source starts emitting light.

17. The method according to claim 10, wherein in the controlling step, the lighting-control on a light source located close to the center of an emission surface preferentially performs.

18. A method of controlling a light source apparatus including:

a light-emitting unit which includes a plurality of emission areas emitting light periodically at different phases and in which at least two light sources are disposed in each emission area; and a detection unit which detects light from the light-emitting unit, the method comprising:

a selecting step of selecting a plurality of light sources of the light-emitting unit sequentially; and a controlling step of performing lighting-control of temporarily reducing emission brightness of light sources other than the selected light source so that light from the selected light source is detected by the detection unit during the periodic light emission of the plurality of emission areas, wherein in the selecting step, the lighting-control target light sources are selected in such an order that a frequency of a low-frequency component of a brightness variation in each of the plurality of emission areas is 60 Hz or higher.

19. The light source apparatus according to claim 1, further comprising an A/D converter configured to convert analog values detected by the detection unit to digital values.

* * * * *